US006450191B1

(12) United States Patent
Welch

(10) Patent No.: US 6,450,191 B1
(45) Date of Patent: Sep. 17, 2002

(54) SIPHONING DEVICE

(76) Inventor: Jason E. Welch, 3540 Merritt Ann Dr., Baton Rouge, LA (US) 70816

( * ) Notice: Subject to any disclaimer, the term of this patent is extended or adjusted under 35 U.S.C. 154(b) by 0 days.

(21) Appl. No.: 09/838,850

(22) Filed: Apr. 20, 2001

(51) Int. Cl.[7] ..... F04F 10/00
(52) U.S. Cl. ..... 137/150; 137/152; 417/234
(58) Field of Search ..... 137/147, 150, 137/152, 153; 417/234

(56) References Cited

U.S. PATENT DOCUMENTS

| | | | | | |
|---|---|---|---|---|---|
| 241,551 | A | | 5/1881 | Lathe et al. | |
| 330,078 | A | * | 11/1885 | Wittram | 137/147 |
| 383,153 | A | * | 5/1888 | Siersdorfer | 137/150 |
| 387,455 | A | * | 8/1888 | Siersdorfer | 137/150 |
| 407,971 | A | * | 7/1889 | Siersdorfer | 137/150 |
| 2,253,474 | A | * | 8/1941 | Weber | 137/150 |
| 2,577,014 | A | * | 12/1951 | Johnson | 137/150 |
| 2,681,072 | A | | 6/1954 | Pasanen | |
| 2,796,880 | A | * | 6/1957 | Betz | 137/150 |
| 3,011,510 | A | * | 12/1961 | Standifird | 137/153 |
| 3,013,575 | A | | 12/1961 | Persson | |
| 3,750,691 | A | * | 8/1973 | Lidolph | 417/234 |
| 4,073,305 | A | | 2/1978 | Brown et al. | |
| D338,372 | S | | 8/1993 | Geneste | |
| 5,234,016 | A | | 8/1993 | Winn | |
| 5,333,639 | A | | 8/1994 | Nelson | |

* cited by examiner

*Primary Examiner*—Gerald A. Michalsky

(57) ABSTRACT

A siphoning device for pumping fuel from one vehicle to another vehicle. The siphoning device includes an elongate flexible conduit for transporting liquids from one location to another location; and also includes a suction-generating member being connected to the elongate flexible conduit and being adapted to effect flow of the liquids through the elongate flexible conduit; and further includes a handle member being attached to the elongate flexible conduit.

6 Claims, 1 Drawing Sheet

SIPHONING DEVICE

BACKGROUND OF THE INVENTION

1. Field of the Invention

The present invention relates to a siphon and more particularly pertains to a new siphoning device for pumping fuel from one vehicle to another vehicle.

2. Description of the Prior Art

The use of a siphon is known in the prior art. More specifically, a siphon heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 241,551; U.S. Pat. No. 5,234,016; U.S. Pat. No. 5,333,639; U.S. Pat. No. Des. 338,372; U.S. Pat. No. 4,073,305; U.S. Pat. No. 2,681,072; and U.S. Pat. No. 3,013,575.

While these devices fulfill their respective, particular objectives and requirements, the aforementioned patents do not disclose a new siphoning device. The inventive device includes an elongate flexible conduit for transporting liquids from one location to another location; and also includes a suction-generating member being connected to the elongate flexible conduit and being adapted to effect flow of the liquids through the elongate flexible conduit; and further includes a handle member being attached to the elongate flexible conduit.

In these respects, the siphoning device according to the present invention substantially departs from the conventional concepts and designs of the prior art, and in so doing provides an apparatus primarily developed for the purpose of pumping fuel from one vehicle to another vehicle.

SUMMARY OF THE INVENTION

In view of the foregoing disadvantages inherent in the known types of siphon now present in the prior art, the present invention provides a new siphoning device construction wherein the same can be utilized for pumping fuel from one vehicle to another vehicle.

The general purpose of the present invention, which will be described subsequently in greater detail, is to provide a new siphoning device which has many of the advantages of the siphon mentioned heretofore and many novel features that result in a new siphoning device which is not anticipated, rendered obvious, suggested, or even implied by any of the prior art siphon, either alone or in any combination thereof.

To attain this, the present invention generally comprises an elongate flexible conduit for transporting liquids from one location to another location; and also includes a suction-generating member being connected to the elongate flexible conduit and being adapted to effect flow of the liquids through the elongate flexible conduit; and further includes a handle member being attached to the elongate flexible conduit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new siphoning device which has many of the advantages of the siphon mentioned heretofore and many novel features that result in a new siphoning device which is not anticipated, rendered obvious, suggested, or even implied by any of the prior art siphon, either alone or in any combination thereof.

It is another object of the present invention to provide a new siphoning device which may be easily and efficiently manufactured and marketed.

It is a further object of the present invention to provide a new siphoning device which is of a durable and reliable construction.

An even further object of the present invention is to provide a new siphoning device which is susceptible of a low cost of manufacture with regard to both materials and labor, and which accordingly is then susceptible of low prices of sale to the consuming public, thereby making such siphoning device economically available to the buying public.

Still yet another object of the present invention is to provide a new siphoning device which provides in the apparatuses and methods of the prior art some of the advantages thereof, while simultaneously overcoming some of the disadvantages normally associated therewith.

Still another object of the present invention is to provide a new siphoning device for pumping fuel from one vehicle to another vehicle.

Yet another object of the present invention is to provide a new siphoning device which includes an elongate flexible conduit for transporting liquids from one location to another location; and also includes a suction-generating member being connected to the elongate flexible conduit and being adapted to effect flow of the liquids through the elongate flexible conduit; and further includes a handle member being attached to the elongate flexible conduit.

Still yet another object of the present invention is to provide a new siphoning device that is safe and convenient to us and also avoids hazardous spills.

Even still another object of the present invention is to provide a new siphoning device that eliminates the user having to try to lift a heavy gas can in order to put fuel in the tank of the vehicle.

These together with other objects of the invention, along with he various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
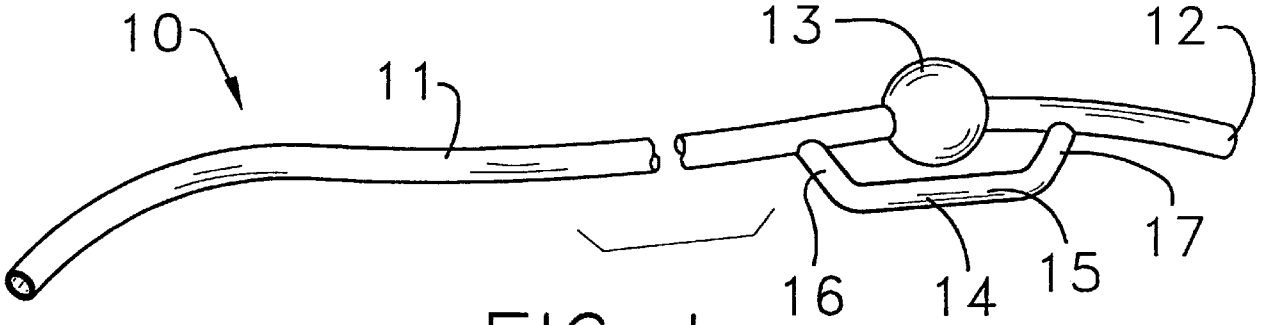
FIG. 1 is a perspective view of a new siphoning device according to the present invention.
Figure 2:
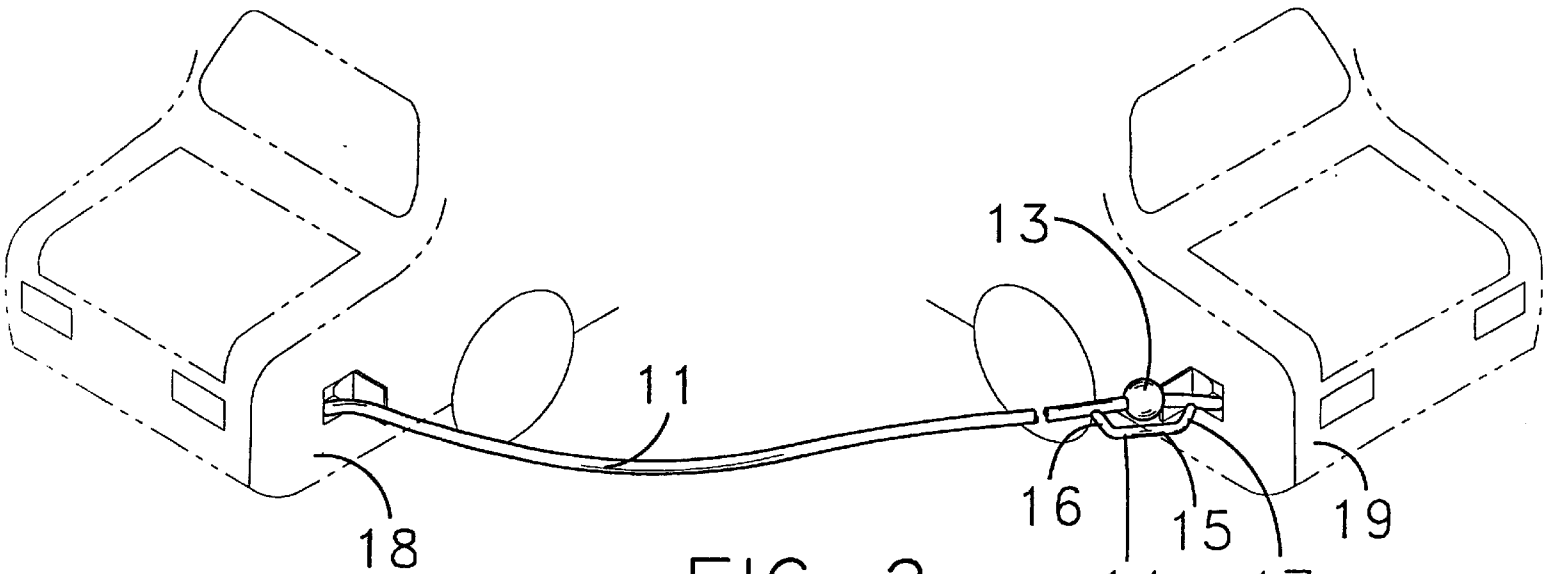
FIG. 2 is a perspective view of the present invention shown in use siphoning between two vehicles.

With reference now to the drawings, and in particular to FIGS. 1 through 2 thereof, a new siphoning device embodying the principles and concepts of the present invention and generally designated by the reference numeral 10 will be described.

As best illustrated in FIGS. 1 through 2, the siphoning device 10 generally comprises an elongate flexible conduit 11 for transporting liquids from one location to another location. The elongate flexible conduit 11 is a hose having a length of approximately 8 to 10 feet. A suction-generating member 13 is conventionally connected to the elongate flexible conduit 11 and is adapted to effect flow of the liquids through the elongate flexible conduit 11. The suction-generating member 13 is a squeezable siphoning bulb being conventionally disposed in-line of the hose 11 near an end 12 thereof and being adapted to create a suction through the hose 11 to cause the liquids to flow therethrough. The squeezable siphoning bulb 13 is disposed approximately 7 to 8 inches from the end 12 of the hose 11. A handle member 14 is conventionally attached to the elongate flexible conduit 11. The handle member 14 includes a main portion 15 and end portions 16, 17 being angled relative to the main portion 15 and being securely and conventionally attached to the exterior of the hose. The squeezable siphoning bulb 13 is disposed between where the end portions 16,17 of the handle member 14 are securely attached.

In use, the user would place an end of the hose 11 in the liquid or fuel source such as a vehicle 18, and would then place the other end 12 of the hose in a fuel receiving member such as the gas tank of the another vehicle 19, and would then squeeze the siphoning bulb 13 to create a suction in the hose 11 thus causing the fuel to flow from the one vehicle 18 to the other vehicle 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A siphoning device comprising:

an elongate flexible conduit for transporting liquids from one location to another location:

a suction-generating member being connected to said elongate flexible conduit and being adapted to effect movement of the liquids through said elongate flexible conduit; and a handle member being attached to said elongate flexible conduit, said conduit having opposite ends mounted on said conduit at spaced locations along said conduit;

wherein said suction-generating member is disposed on said conduit between said spaced locations on said conduit such that said handle bridges over said suction-generating member.

2. A siphoning device as described in claim 1, wherein said elongate flexible conduit is a hose.

3. A siphoning device as described in claim 1, wherein said suction-generating member is a squeezable siphoning bulb being disposed in-line of said conduit near an end thereof and being adapted to create a suction through said conduit to cause the liquids to flow therethrough.

4. A siphoning device as described in claim 1, wherein said handle member includes a main portion and end portions being angled relative to said main portion.

5. A siphoning device comprising:

an elongate flexible conduit for transporting liquids from one location to another location;

a suction-generating member being connected to said elongate flexible conduit and being adapted to effect movement of the liquids through said elongate flexible conduit; and a handle member being attached to said elongate flexible conduit;

wherein said elongate flexible conduit is a hose;

wherein said suction-generating member is a squeezable siphoning bulb being disposed in-line of said conduit near an end thereof and being adapted to create a suction through said conduit to cause the liquids to flow therethrough;

wherein said handle member includes a main portion and end portions being angled relative to said main portion;

wherein said squeezable siphoning bulb is disposed between where said end portions of said handle member are securely attached.

6. A siphoning device comprising:

an elongate flexible conduit for transporting liquids from one location to another location, said elongate flexible conduit being a hose having a length of approximately 8 to 10 feet;

a suction-generating member being connected to said elongate flexible conduit and being adapted to effect movement of the liquids through said elongate flexible conduit, said suction-generating member being a squeezable siphoning bulb being disposed in-line of said hose near an end thereof and being adapted to create a suction through said hose to cause the liquids to flow therethrough, said squeezable siphoning bulb being disposed approximately 7 to 8 inches from said end of said hose; and a handle member being attached to said elongate flexible conduit, said handle member including a main portion and end portions being angled relative to said main portion and being securely attached to said hose, said squeezable siphoning bulb being disposed between where said end portions of said handle member are securely attached.

* * * * *